US009867232B2

(12) United States Patent
Mann et al.

(10) Patent No.: US 9,867,232 B2
(45) Date of Patent: Jan. 9, 2018

(54) HEATING ELEMENT AND PROCESS HEATER

(71) Applicant: SANDVIK IMATERIALS TECHNOLOGY DEUTSCHLAND GMBH, Dusseldorf (DE)

(72) Inventors: Markus Mann, Mainz (DE); Michael Kramer, Morfelden-Walldorf (DE)

(73) Assignee: SANDVIK MATERIALS TECHNOLOGY DEUTSCHLAND GmbH, Dusseldorf (DE)

( * ) Notice: Subject to any disclaimer, the term of this patent is extended or adjusted under 35 U.S.C. 154(b) by 0 days.

(21) Appl. No.: 15/035,678

(22) PCT Filed: Feb. 10, 2015

(86) PCT No.: PCT/EP2015/052712
§ 371 (c)(1),
(2) Date: Nov. 15, 2016

(87) PCT Pub. No.: WO2015/128183
PCT Pub. Date: Sep. 3, 2015

(65) Prior Publication Data

US 2017/0094725 A1 Mar. 30, 2017

(30) Foreign Application Priority Data

Feb. 25, 2014 (DE) ..... 10 2014 102 474

(51) Int. Cl.
*F24H 1/10* (2006.01)
*H05B 3/44* (2006.01)
*F24H 3/00* (2006.01)

(52) U.S. Cl.
CPC ..... *H05B 3/44* (2013.01); *F24H 3/002* (2013.01); *H05B 2203/003* (2013.01); *H05B 2203/014* (2013.01); *H05B 2203/022* (2013.01)

(58) Field of Classification Search
None
See application file for complete search history.

(56) References Cited

U.S. PATENT DOCUMENTS 1,727,584 A 9/1929 Carleton
3,594,544 A * 7/1971 Wunderlich ..... B01J 19/0013 126/400

(Continued)

FOREIGN PATENT DOCUMENTS

CN 102811514 A 12/2012
DE 735982 C 6/1943

(Continued)

OTHER PUBLICATIONS

Auszuge aus Kapitel G2, VDI-Warmeatlas, 11. Auflage, 2013.

(Continued)

*Primary Examiner* — Thor Campbell
(74) *Attorney, Agent, or Firm* — Corinne R. Gorski

(57) ABSTRACT

A heating element for heating gases to high temperatures includes at least one tube arranged for the flow of gas to be heated and an electrical heating wire in the tube, which transfers heat to the gas flowing past. A process heater and a corresponding heating element are provided to permit generation of gas temperatures up to 1000° C. or above and having a lifespan 10 times longer than conventional heating coils. The heating wire is formed as a heating rod extending along the tube axis, whose maximum clear distance to the inner wall of the tube does not exceed a value of 10 mm over at least 80% of the circumference and/or at least 80% of the overlapping length of the tube and heating rod.

18 Claims, 4 Drawing Sheets

SECTION A-A

(56) References Cited

U.S. PATENT DOCUMENTS 3,783,236 A * 1/1974 Edin ..... F24H 3/0405 219/401
3,828,161 A 8/1974 Yamaguchi
4,085,308 A * 4/1978 Youngquist ..... F24H 1/102 137/341
4,179,603 A * 12/1979 Zeigler ..... H05B 3/64 219/408
4,395,618 A * 7/1983 Cunningham ..... H05B 3/82 165/160
4,877,990 A * 10/1989 Fiorenzano, Jr. ..... A61L 9/16 392/373
5,134,684 A * 7/1992 Mishou ..... H05B 3/44 392/379
5,380,987 A 1/1995 Morici
5,400,432 A * 3/1995 Kager ..... F24H 1/102 165/160
5,872,890 A * 2/1999 LaCombe ..... F24H 1/102 392/487
6,078,730 A * 6/2000 Huddart ..... A61M 16/08 219/536
6,289,177 B1 * 9/2001 Finger ..... F24H 1/102 392/447
6,456,785 B1 * 9/2002 Evans ..... F24H 1/102 392/448
6,621,985 B1 * 9/2003 Thweatt, Jr. ..... F24H 1/225 392/465
6,683,285 B2 * 1/2004 Wyss ..... G05D 23/1906 219/536
7,162,149 B2 * 1/2007 Evans ..... F22B 1/282 392/386
7,576,306 B2 * 8/2009 Lewin ..... H05B 3/44 219/202
8,214,936 B2 * 7/2012 Thweatt, Jr. ..... F28D 7/0066 4/493
2012/0141100 A1 6/2012 Evans
2013/0264326 A1 10/2013 Tiras et al.

FOREIGN PATENT DOCUMENTS

DE 1615278 A1 7/1970
DE 19613411 C1 8/1997
EP 2134143 A1 12/2009
KR 101314531 B1 10/2013

OTHER PUBLICATIONS

Datenblatt der Omega Enginerring, Daimlerstr. 26, 75329 Deckenpfronn betreffend den Heizwiderstandsdraht Ni80.
Auszuge aus Kories/Schmidt-Walter, Taschenbuch der Elektrotechnik:, 5. Auflage, 2003, Seiten 58 and 576.

* cited by examiner

SECTION A-A

HEATING ELEMENT AND PROCESS HEATER

RELATED APPLICATION DATA

This application is a §371 National Stage Application of PCT International Application No. PCT/EP2015/052712 filed Feb. 10, 2015 claiming priority of DE Application No. 102014102474.5, filed Feb. 25, 2014.

FIELD OF THE INVENTION

The present invention concerns a heating element for heating gases to high temperatures comprising at least one tube 1 which is adapted for the flow therethrough of hot gas or gas to be heated and an electrical heating wire in the tube, which is designed for the transfer of heat to the gas flowing past the heating wire.

The present invention also concerns a process heater having a housing having a gas feed and a gas outlet, a heating space between the gas feed and the gas outlet for accommodating a heating element and electrical connections for at least one heating element.

BACKGROUND

Corresponding heating elements have long been known. As already mentioned they comprise at least one tube through which gas is to flow and which is open at both ends for the purposes of the flow of gas therethrough, wherein arranged in the tube is a heating wire along which the gas flows and is heated by the direct contact with the heating wire.

Usually the heating wires are in the form of fine wires which are wound in a spiral configuration and whose cross-section is very much smaller than the tube cross-section and which have current passing therethrough and are thereby heated. The electrical energy converted into heat by the heating wire obviously depends on the available electrical voltage and the resistance of corresponding heating wires, in which respect to achieve desired resistance values the length of a spiral-wound wire can be correspondingly adapted or a plurality of corresponding heating wires can be connected in parallel or also in series. It will be appreciated that in that case the heat energy transferred to the gas flowing along the heating wire depends on the maximum temperature that the heating wire achieves, the flow resistance and the surface area available for heat exchange, as well as the precise flow conditions in the heating element. The maximum gas temperatures which can be regularly achieved in practice in continuous operation with such process heaters are of the order of magnitude of 700° C.

Admittedly heating elements or process heaters are also occasionally offered, which make it possible to produce higher gas temperatures of up to about 900° C., but those have only extremely short service lives. With the gas flow rates required for many processes the heating wire itself necessarily always involves a temperature which is more or less markedly above the gas temperature, in which respect even the smallest non-homogeneities in the heating wire or in the cross-section thereof or also unfavourable local flow conditions and turbulence phenomena can have the result that some portions of the heating wire heat up more greatly than the remaining part, which then rapidly results in fracture and failure of the heating wires. As the heating wire typically contains small amounts of aluminium contact with oxygen initially leads to the formation of a protective aluminium oxide layer around the wire. After consumption of the aluminium component however other alloy constituents like iron and chromium react with the oxygen, which generally signifies the end of the operating life of the heating wire. Other chemical reactions in respect of the process gas which is hot or which is to be heated with the material of the heating wire can also speed up failure or fracture of the heating wires. Small irregularities in the material or the cross-section of the heating wire due to chemical changes quickly lead to local overheating of the heating wire and fracture. As the stability of the very thin coiled heating wires is very low, in particular at high temperatures, the heating coils in a vertical tube can easily collapse into themselves, thereby giving rise to short-circuits which also reduce the operating life of such coiled wires. Such a failure due to overheating, in particular local overheating, occurs correspondingly more easily, the smaller the cross-section or diameter of the heating wires. On the other hand however a large surface area-to-volume ratio of the heating wires is deemed to be advantageous for effective transfer of the heat energy produced in the heating wire to the gas flowing past same, so that hitherto the short service life of such heating elements has been accepted if the aim is to achieve gas temperatures in the region of 900° C. or above.

Process heaters and heating elements which produce gas temperatures of 900° C. or even still higher usually only have a service life of a few hours for the above-mentioned reasons.

SUMMARY

With that background in mind the problem of the present invention is to provide a process heater and a corresponding heating element which allow a production of gas temperatures of up to 1000° C. or even higher so that extremely large amounts of energy can be transferred to the gas and nonetheless have a relatively long service life which in the production of gas temperatures of up to 1000° C. is generally at least 10 times the operating life of conventional heating coils.

That problem is solved in that the heating wire is in the form of heating rod which extends along the tube axis and whose maximum internal spacing relative to the inside wall of the tube does not exceed a value of 10 mm over at least 80% of the periphery and/or at least 80% of the overlap length of the tube and the heating rod.

In other words the heating wire is not a coiled wire whose material cross-section is substantially smaller than that of the tube, but rather a rod for which in turn it is possible to define a corresponding longitudinal axis which extends substantially along the or parallel to the axis of the tube and in that respect fills the tube to such an extent that only a relatively small internal spacing remains between the heating rod and the tube wall, which at a maximum is 10 mm and is preferably even markedly less, even if it may be larger at points, that is to say in regions which constitute less than 20% of the overlap length of the tube and the heating rod or however less than 20% of the periphery of the heating rod. The term "heating wire" is therefore used in the context of the present description as a generic term both for relatively thin coiled wires and also for heating rods according to the present invention, wherein the differing thickness is not the primary distinguishing criterion.

In many practical cases the maximum internal spacing between the heating rod and the tube is between 1 and 2 mm, somewhat above same or also below same down to minimal values of 0.02 mm. The maximum diameter of the heating rod is rarely above 10 mm because at even larger diameters the efficiency of the transfer of energy falls considerably because of a relatively high volume/surface area ratio of the heating rod, which can be only partially compensated by a greater tube and heating rod length. In principle however the use of heating rods of larger diameters is nonetheless possible, even if not preferred. A diameter range for heating rods in accordance with the present invention, which is apparently desirable in practice, is between 0.5 mm and 5 mm.

The term "tube" is to be broadly interpreted in accordance with the present invention and ultimately defines only a hollow space having an inlet and an outlet opening which allow gas to be heated to flow therethrough. In that respect the cross-section over the length of the tube does not even have to be constant, even if that is obviously preferred, in order to produce a substantially constant gap, in particular a constant annular gap, between the heating rod and the tube wall, using simple means. The annular gap can be interrupted by raised portions which are disposed distributed around the periphery on the heating rod surface or on the inside surface of the tube in order to permit centring of the heating road and to ensure homogeneous transfer of heat.

By way of example through bores in a solid block are also viewed as tubes, wherein such a block can have a multiplicity of parallel bores.

As the heating rods according to the present invention are relatively thick in comparison with the coiled wires in corresponding tubes of conventional heaters they can internally better transfer heat and distribute same, which helps to avoid local overheating, and for that reason alone, with a high thermal loading or high heating rod temperatures beyond 1000° C., they have a markedly longer operating life and life span or first make it possible to heat gases to over 1000° C. with metallic electrical heating elements.

An alternative condition instead of the maximum internal spacing between the heating rod and the tube can be expressed by a minimum ratio of the cross-sectional area of the heating rod relative to the free internal cross-section of the tube. In accordance therewith, at least insofar as it extends within the tube, the heating rod should be of a cross-sectional area which is at least 30% and still more preferably at least 50% of the free tube cross-section. In specific embodiments which were tested with positive results that cross-sectional ratio was about 80%, wherein the maximum internal spacing was 0.2 to 0.5 mm and a correspondingly uniform annular gap between the heating rod and the tube wall was about 0.1 to 0.25 mm.

In general terms the preferred size ratios between the cross-section of the heating rod and the internal cross-section of the tube are desirably in the range of 0.2 to about 0.95. A cross-sectional ratio of 0.2 is afforded for example approximately with a very thin heating rod diameter of 0.2 mm and a tube diameter of 0.45 mm. A cross-sectional ratio of 0.9 is afforded for example with a heating rod diameter of about 4.75 mm in a tube with an inside diameter of 5 mm, in which respect in regard to the cross-sectional ratios the unit of size or the absolute dimensions are not an important consideration as long as the heating rod diameter is within the ranges specified hereinbefore and hereinafter. A preferred range of cross-sectional ratios is between 0.3 and 0.8, corresponding to a diameter ratio of between about 0.5 and 0.9 with absolute diameters of the heating rods of between 0.5 and 5 mm.

At the same time it has been found that, with a substantially laminar flow of gas through an annular gap between a rod-shaped heating rod extending along the tube axis and the inside wall of the tube, the transfer of heat between the heating rod and the gas flowing therethrough is surprisingly effective so that process gas temperatures of up to 1200° C. or even above can be readily achieved with such a heating element, while the service life of those process heaters and in particular the heating rods is a multiple of the service life of conventional process heaters or heating wires, which are designed for producing gas temperatures of 900° C. or more. In that respect the annular gap does not necessarily have to be of a constant width along the periphery of the heating rod, but can vary between 0 (contact) and the maximum value (in the case of circular cross-sections), that is to say double the uniform gap width.

The absolute tube diameters and heating rod diameters can vary in wide ranges, for example between an inside diameter of the tube of 1 mm to 20 mm or even more, for example 60 mm, once again dependent on the other dimensions like for example the length of the tube and the heating rod, the desired width of the annular gap, the gas flow rate and the electrical resistance of the heating rod as well as the available voltage.

It will be appreciated that with small tube diameters the heating rod is of a correspondingly smaller diameter which in the extreme case can even be 0.5 mm or less, for example 0.2 mm. It is however always still markedly thicker in comparison with conventional coiled wires or heating filaments and in particular is not coiled but extends parallel to the tube axis and along the tube axis. The difference between the "heating wire" according to the state of the art and the "heating rod" according to the invention is therefore primarily not (or not only) in the differing thickness but rather in the defined longitudinal extent and comparatively stable shape of the heating rod which, insofar as is viable in practice, extends precisely along the axis of the tube so that its length within the tube precisely corresponds to the length of the tube and the heating rod does not therefore extend along an artificially prolonged distance in the tube. Nonetheless the heating rod of a heating element according to the present invention is generally also thicker than the heating wires in conventional heating elements of the same tube cross-section and in the case of a heating element according to the state of the art, which is overall comparable in terms of heating power.

Ideally the heating rod is arranged as precisely as possible in the centre of the tube, wherein the external cross-section of the heating rod is substantially identical to the shape of the internal cross-section of the tube, which accordingly means that the annular gap between the heating rod and the inside wall of the tube is of a substantially constant width. Possibly however the inside surface of the tube and/or the outside surface of the heating rod could also be structured, that is to say for example they could have a rib or groove structure which extends in the longitudinal direction of the rod and the tube and which can also have a small twist angle. With a given annular gap width such surface structures can possibly increase the region of the laminar flow towards higher gas flow rates.

In this respect the specific width of the annular gap always represents a compromise between maximum heat energy transfer and pressure loss at a desired gas flow rate. In other words, the narrower the annular gap, the correspondingly more effective is the transfer of heat from the heating rod to the gas flowing between the heating rod and the tube, in which respect however a narrow gap also limits the gas flow and/or requires a high pressure difference between inlet and outlet.

In addition the appropriate width of the annular gap also depends on the length of the tube and also the electrical heating power implemented in the heating rod.

In a specific embodiment the average width of the annular gap is about 0.1 mm, in another example 0.2 mm, in which respect however it is not always possible for the heating rod to be actually arranged concentrically in a tube so that the width of the annular gap, at least at some axial positions, can vary in the peripheral direction between zero and double the average annular gap width.

In an embodiment therefore spacers are provided at some positions distributed around the periphery and/or over the length, to centre the heating rod in the tube. The spacers can be in one piece with the heating rod or the tube and in particular are of such a configuration that they hinder the gas flow between the heating rod and the tube as little as possible. The spacers preferably comprise heat-resistant ceramic and are ideally implemented by way of the tube geometry.

Ideally the heating rod and the tube are arranged in mutually coaxial relationship, that is to say their axes coincide.

In that respect however the heating rod and the tube do not in any way have to be of a circular cross-section, for example they could also involve the cross-section of a preferably equilateral polygon, and it would also be possible to use a tube of hexagonal or octagonal cross-section or external contour which accommodates a cylindrical heating rod. In particular a square or hexagonal external contour for the tubes permits a highly compact arrangement of the tube bundle and, resulting therefrom, a minimum bypass flow between the tubes.

In an embodiment of the invention a plurality of parallel tubes are combined together to form a tube pack and the heating rod, more precisely the heating rods of the individual tubes of the tube pack, are in the form of a heating wire which is passed in a meander configuration through the tubes and which is introduced at the end of a tube and which from the exit side of that tube is taken back again through an adjacent tube, and so forth. In that case the number of tubes through which an individual heating wire is passed as a heating rod is preferably an even number so that the heating rod in the form of a wire which extends to and fro through the plurality of rods issues on the same side as the entry end in parallel relationship therewith and can thus be connected at one end of the tube pack to corresponding electrical connecting contacts. It will be appreciated that a tube pack can comprise a plurality of groups of tubes which each have a single interconnected heating wire passing therethrough. If the electrical connecting power should require it, division into a plurality of electrical zones has proved its worth, permitting connection in a delta or star connection.

Desirably a dense packing of such tubes is arranged in a common housing, wherein insulating material is additionally also disposed between the housing wall and the outside of the dense packing, comprising individual tubes.

The insulating material is preferably a high temperature-resistant ceramic material involving sufficient stability for producing tubes which are stable in respect of shape. A high temperature-resistant ceramic insulating material as is marketed by the applicant under the brand name "Fibrothal" can be arranged between a plurality of parallel tubes which are assembled to constitute a pack.

Instead of being in mutually juxtaposed relationship a plurality of the heating elements according to the invention and corresponding packs of heating elements can also be arranged axially one after the other.

The tubes should comprise an insulating and high temperature-resistant ceramic, in particular aluminium oxide (Al2O3) being considered for the purpose.

The heating rod preferably comprises an iron-chromium-aluminium alloy or a nickel-chrome-iron alloy. Optionally in particular a thicker heating rod could in turn also comprise a bundle of parallel individual rods or wires which are possibly also twisted together, wherein with such an embodiment the above-defined internal spacing is defined by the internal spacing of an envelope of the bundle of rods or wires relative to the inside wall of the tube.

The heating rod can be of a diameter in the range of 0.2 to 50 mm, preferably between 0.5 and 10 mm.

Further advantages, features and possible uses of the present invention will be clearly apparent from the description hereinafter of a preferred embodiment and the accompanying Figures

DETAILED DESCRIPTION

Figure 1:
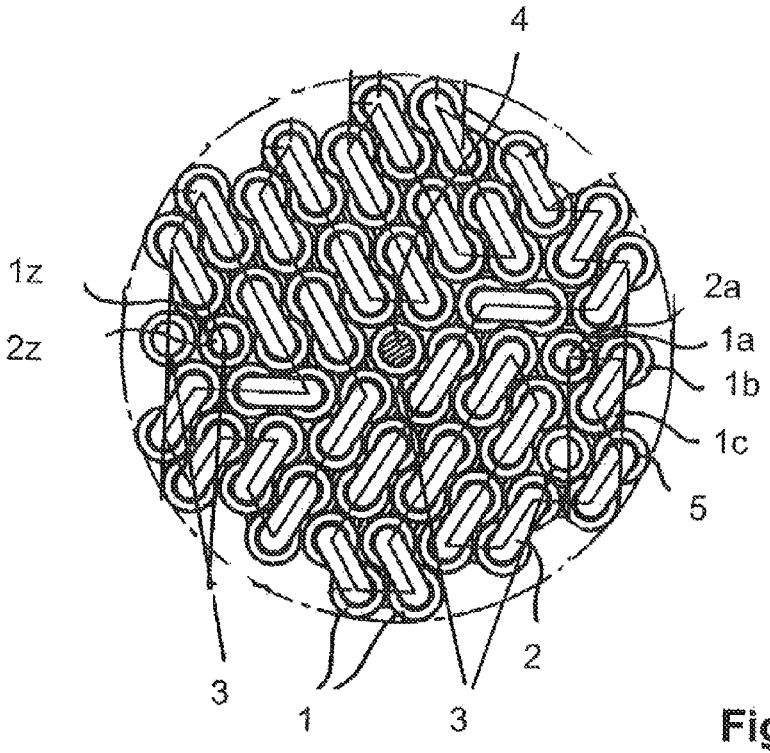
FIG. 1 shows a plan end view of a heating element having a bundle of tubes with heating rods passed therethrough.

FIG. 1 shows a dense packing of tubes 1 in a hexagonal arrangement, through which heating rods 2 are passed. The tubes 1 comprise aluminium oxide ceramic and are of an inside diameter of about 1.7 mm and an outside diameter of about 2.7 to 2.8 mm, giving a wall thickness for the tubes 1 of about 0.5 to 0.55 mm. The heating rods here are formed by a continuous heating wire of a diameter of about 1.5 mm which is passed alternately in respective opposite directions through a plurality of the tubes of this tube pack, wherein the heating rod marked by 2*a* marks the entry side of the heating wire into the tube 1*a*, which is then taken back through the tube 1*b* again, introduced into the tube 1*c* again and in that way passed through a plurality of tubes and substantially parallel to the axis thereof until finally the end of the wire issues in the form of the heating rod 2*z* through the tube 1*z* again.

Some of the tubes are empty tubes 3 which for example serve to accommodate thermoelements or other thermometers while the central tube can have for example a centring means 4, by means of which the heating element 10 comprising the tube pack and the heating wire passed therethrough can be centred in the housing of a process heater.

Figure 2:
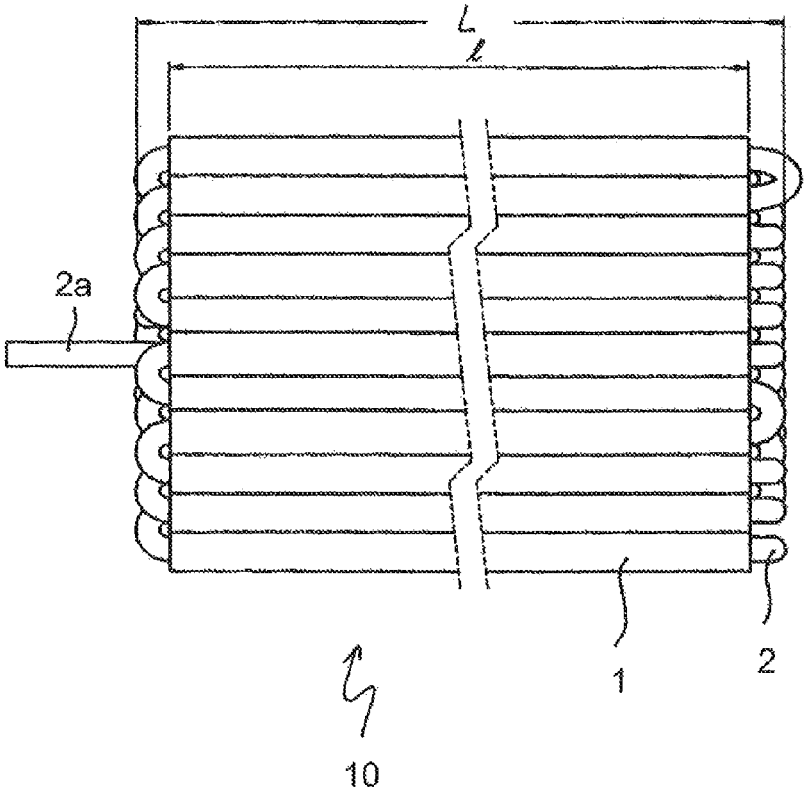
FIG. 2 shows a side view of the heating element of FIG. 1.

FIG. 2 shows a side view of the pack or the hexagonal packing of tubes as shown in FIG. 1.

The length of the tubes 1 is for example between 150 and 500 mm while the length L of the overall heating element 10 (without the projecting connection ends 2*a* and 2*z*) with the sizes specified herein in respect of tubes 1 and heating rods 2 is about 4-5 mm larger.

Figure 3:
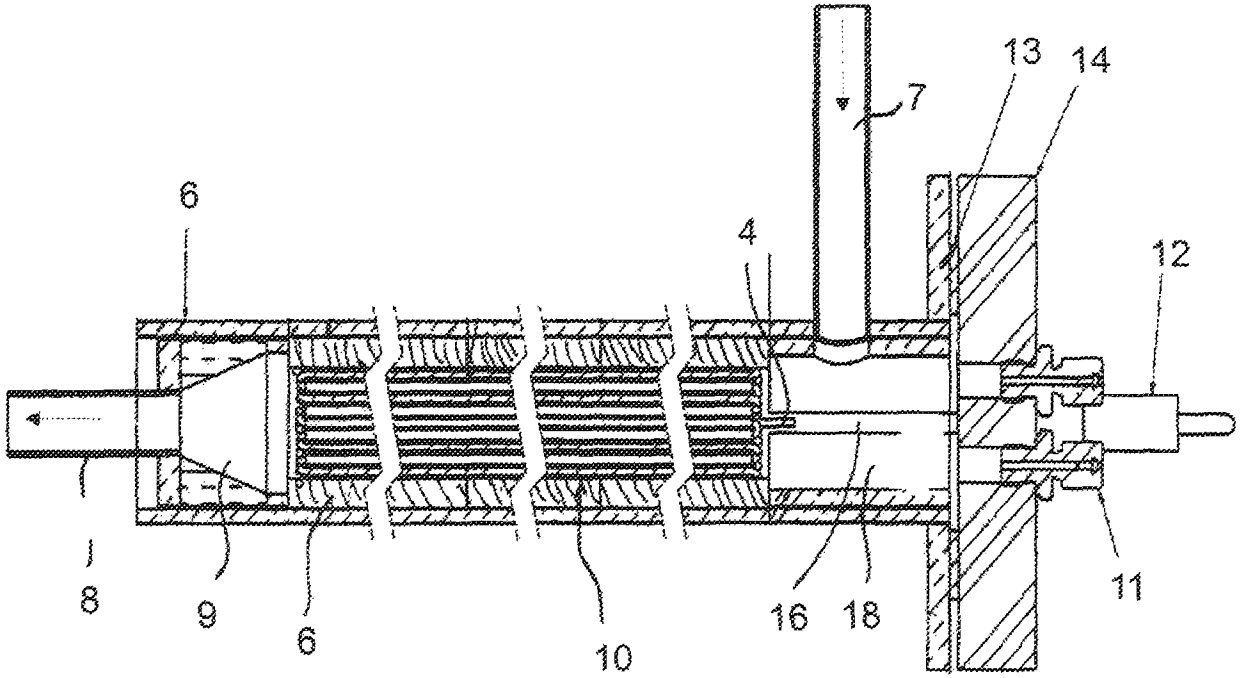
FIG. 3 shows a cross-sectional view taken along a section of the longitudinal axis of a complete process heater with a heating element according to the invention and a housing with connections for gas and current and an insulation.

FIG. 3 shows a complete process heater 100 having a tubular housing 6, a gas feed tube 7, a gas outlet nozzle 9 with outlet tube 8 and a fixing flange 13 which in turn is mounted to a current feed flange 14.

Figure 5:
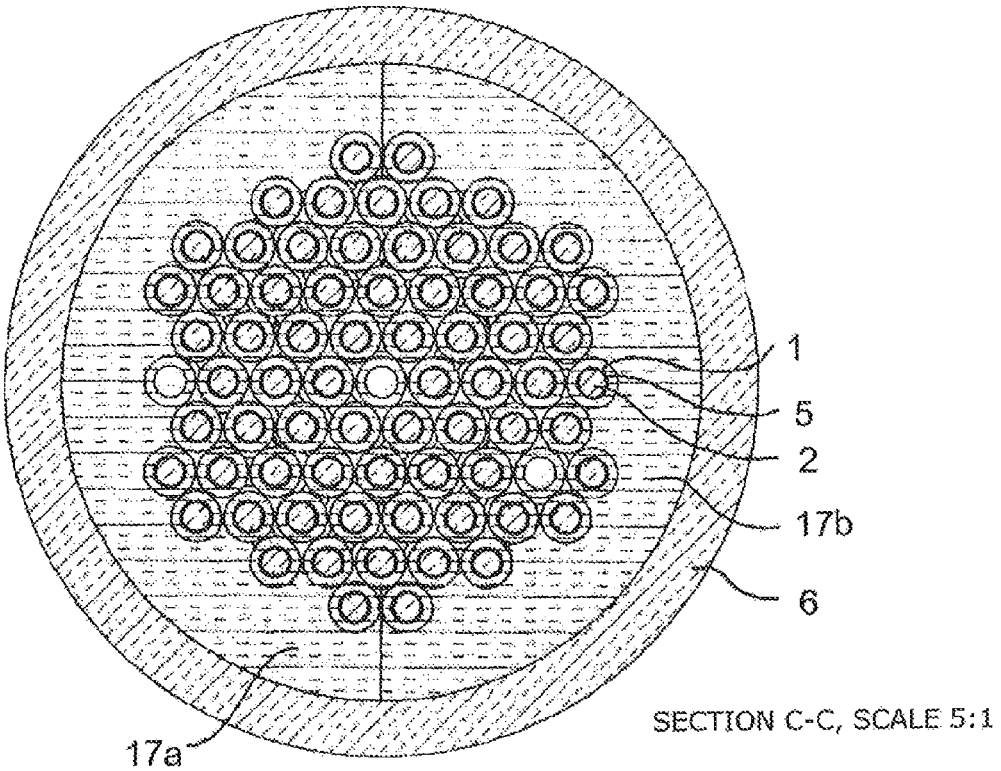
FIG. 5 shows a section through a heating element as shown in FIGS. 1 and 2.
Figure 6:
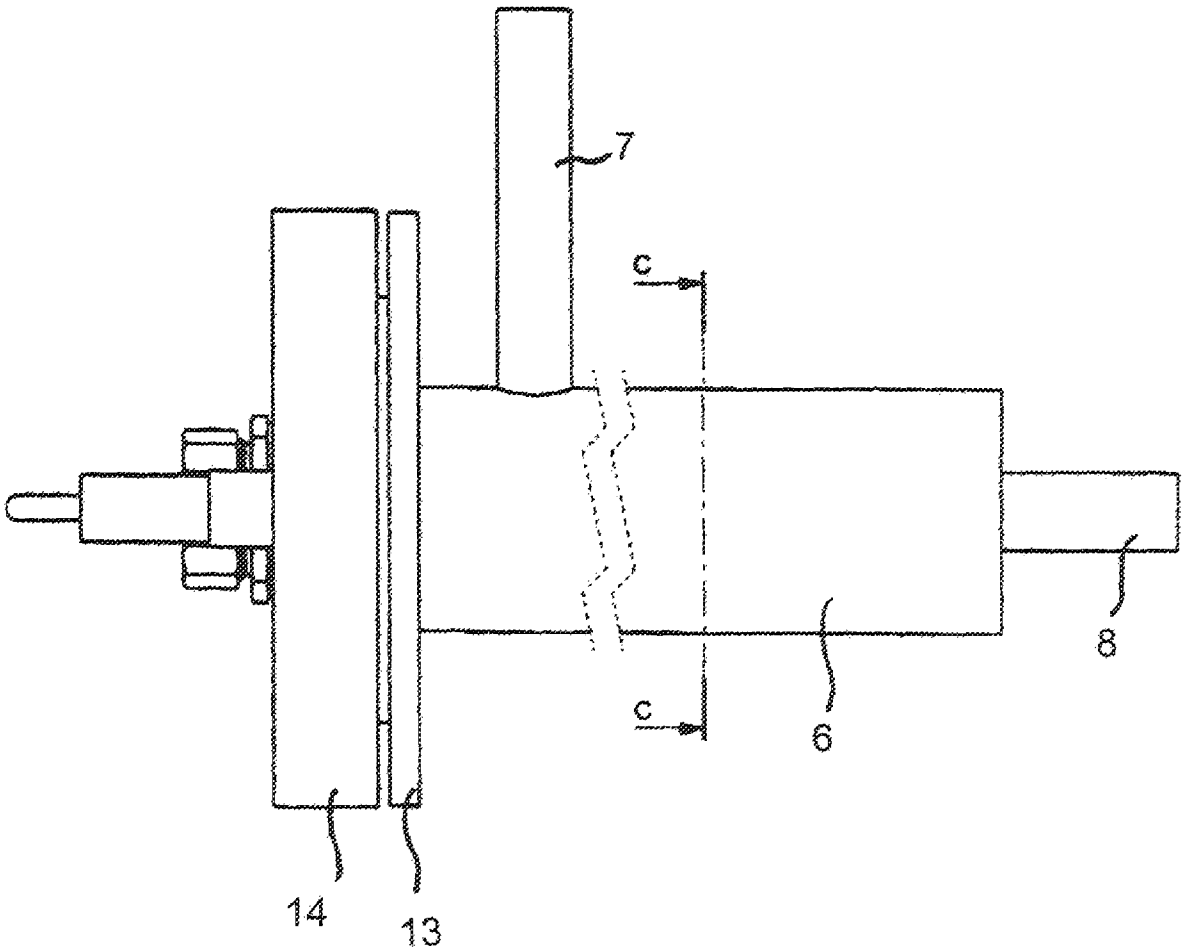
FIG. 6 diagrammatically shows a process heater taken along the section line in FIG. 5.

The gas feed tube 7 opens into a cylindrical cavity 18 through which there also extend two parallel current connecting tubes 16 of which the side view in FIG. 3 shows only one. The current connecting tubes form a passage means for the connection of the wire ends 2*a* and 2*z* to electrical connecting contacts on the electrical connecting flange 14. The heating element 10 which comprises a tube pack for example as shown in FIGS. 1 and 2 is accommodated in the centre of the tubular housing 6, wherein disposed between the inside wall of the tubular housing 6 and the heating element 10 is a high temperature-resistant, ceramic insulating material 17 which typically comprises two half-shells 17*a*, 17*b* (see FIG. 5) which embrace the heating element 10 from opposite sides and the inside contour of which is matched to the outside contour of the heating element 10.

Alternatively the half-shells can also jointly form a simple cylindrical tube, in which case then the remaining intermediate spaces between the heating element 10 are plugged with insulating material which is present in loose fibre composite form and which moreover also fills the intermediate spaces between the tubes 1, 3.

As an alternative to plugging of the tube intermediate spaces the gas inlet side of the heating element 10 can also have a suitable apertured circular cover disk whose diameter corresponds to the maximum outside diameter of the tube pack of the heating element 10 and which has bores only at the positions of tubes or the tube openings and which thus covers over the entire end of the tube pack with the exception of the bores, before the heating wire is passed through the tubes. Such a cover disk could comprise the same ceramic insulating material as is also used for the half-shells 17*a*, 17*b* between the housing and the heating element 10 and which is marketed by the applicant under the brand name "Fibrothal". The ends 2*a* and 2*z* of the heating wire or the heating rods 2 are connected by the insulating connecting tubes 16 to external electrical connections 12 which are mounted to the feed flange 14 by way of a clamping ring screw means 13.

The variant illustrated here of a process heater is designed for a heating power of 3.5 kW, with a heating rod or heating wire diameter of about 1.5 mm, wherein the internal tube diameter can be between about 1.7 and 2.2 mm and wherein the heating wire or the heating rods comprise an iron-chromium-aluminium alloy. Suitable heating wires are marketed by the applicant inter alia under the brand name "NICROTHAL". It will be appreciated that corresponding process heaters can be of any dimensions so that the power range can extend between some watts or some 100 watts and 100 or more kilowatts.

The gas to be heated is fed through the connection 7 and passes into a substantially cylindrical preliminary chamber 18 which otherwise also has the two insulating tubes 16 of the current connection passing therethrough, and flows into the open annular gap 5 between the tubes 1 and the heating wires 2 and through the tubes in order then to issue from the process heater by way of the nozzle 9 and the outlet tube 8.

It will be appreciated that a plurality of heating elements or process heaters can also be connected axially one after the other.

Figure 4:
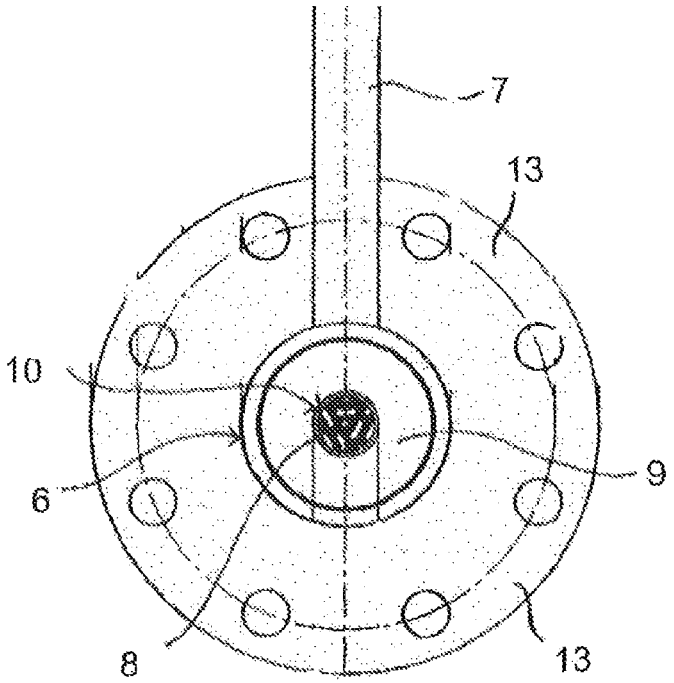
FIG. 4 shows an end view from the left of the process heater of FIG. 3.

FIG. 4 finally also shows an end view of the process heater of FIG. 3 from the left, in which case once again it is possible to see the nozzle 9 with the outlet end 8, and likewise the housing 6, the gas feed tube 7 and the connecting flange 13.

The invention claimed is:

1. A heating element for heating gases to high temperatures comprising:

at least one tube arranged for the flow therethrough of a gas to be heated; and an electrical heating wire disposed in the at least one tube for the transfer of heat to the gas flowing past the heating wire, wherein the heating wire is a heating rod extending along an axis of the tube, and having a maximum internal spacing relative to an inside wall of the at least one tube that does not exceed a value of 10 mm over at least 80% of a periphery and/or at least 80% of an overlap length of the at least one tube and the heating rod, wherein a ratio of a cross-section of the heating rod to an internal cross-section of the tube is in the range of between 0.04 and 0.95.

2. A heating element according to claim 1, wherein a diameter of the heating rod is in the range of 0.2 to 50 mm.

3. A heating element according to claim 1, wherein the ratio of the cross-section of the heating rod to the internal cross-section of the tube is in the range of between 0.3 and 0.8.

4. A heating element according to claim 1, wherein the maximum internal spacing between the heating rod and the inside wall of the at least one tube is between 0.02 and 5 mm.

5. A heating element according to claim 1, wherein the internal spacing between the heating rod and the inside wall of the at least one tube is defined by an annular gap which is substantially constant over the overlap length and the periphery.

6. A heating element according to claim 5, wherein the internal spacing or the width of the annular gap is in the range of 0.05 to 1 mm.

7. A heating element according to claim 1, comprising a plurality of parallel tubes with heating rods which are arranged in a dense packing in a mutually juxtaposed relationship.

8. A heating element according to claim 1, wherein the at least one tube is aluminium oxide.

9. A heating element according to claim 1, wherein the heating rod is made of an iron-chromium-aluminium alloy or a nickel-chromium alloy.

10. A heating element according to claim 1, wherein the heating rod comprises a bundle of parallel individual rods or wires which are twisted together.

11. A heating element according to claim 1, wherein provided between the heating rod and the wall of the at least one tube are spacers.

12. A heating element according to claim 1, wherein the inside surface of the at least one tube is structured.

13. A heating element according to claim 1, wherein the intermediate space between a plurality of tubes and between tubes and housing is filled by a high temperature-resistant, ceramic fibre material and sealed off.

14. A heating element according to claim 5, wherein the internal spacing or the width of the annular gap is in the range of 0.1 and 0.5 mm.

15. A heating element according to claim 10, wherein the internal spacing is defined by the internal spacing of an envelope of the bundle relative to the inside wall of the at least one tube.

16. A heating element according to claim 11, wherein the spacers extend from the tube geometry.

17. A heating element for heating gases to high temperatures comprising:

at least one tube arranged for the flow therethrough of a gas to be heated; and an electrical heating wire disposed in the at least one tube for the transfer of heat to the gas flowing past the heating wire, the heating wire being a heating rod extending along an axis of the tube, and having a maximum internal spacing relative to an inside wall of the at least one tube that does not exceed a value of 10 mm over at least 80% of a periphery and/or at least 80% of an overlap length of the at least one tube and the heating rod, wherein the heating rod extends in the form of a continuous solid heating wire in a meandering configuration through a plurality of parallel tubes.

18. A process heater comprising:

a housing having a gas feed and a gas outlet;

a heating space located between the gas feed and the gas outlet;

at least one electrical heating element disposed in the heating space, the at least one heating element including at least one tube arranged for the flow therethrough of a gas to be heated;

an electrical heating wire disposed in the at least one tube for the transfer of heat to the gas flowing past the heating wire, the heating wire being a heating rod extending along an axis of the at least one tube, and having a maximum internal spacing relative to an inside wall of the at least one tube that does not exceed a value of 10 mm over at least 80% of a periphery and/or at least 80% of an overlap length of the at least one tube and the heating rod; and electrical connections for the at least one electrical heating element.

* * * * *